US011649079B2

(12) United States Patent
Sellars

(10) Patent No.: US 11,649,079 B2
(45) Date of Patent: May 16, 2023

(54) METHOD AND APPARATUS FOR REFILLING A CONTAINER

(71) Applicant: Michael J. Sellars, Leeds (GB)

(72) Inventor: Michael J. Sellars, Leeds (GB)

( * ) Notice: Subject to any disclaimer, the term of this patent is extended or adjusted under 35 U.S.C. 154(b) by 0 days.

(21) Appl. No.: 17/275,384

(22) PCT Filed: Sep. 13, 2019

(86) PCT No.: PCT/GB2019/052576

§ 371 (c)(1),
(2) Date: Mar. 11, 2021

(87) PCT Pub. No.: WO2020/053595

PCT Pub. Date: Mar. 19, 2020

(65) Prior Publication Data

US 2021/0362887 A1 Nov. 25, 2021

(30) Foreign Application Priority Data

Sep. 14, 2018 (GB) ..... 1814977

(51) Int. Cl.
*B65B 3/04* (2006.01)
*B65B 3/18* (2006.01)
*B67D 3/04* (2006.01)

(52) U.S. Cl.
CPC ..... *B65B 3/045* (2013.01); *B65B 3/18* (2013.01); *B67D 3/043* (2013.01)

(58) Field of Classification Search
CPC ..... B65B 3/045; B65B 3/17; B05B 11/0097
See application file for complete search history.

(56) References Cited

U.S. PATENT DOCUMENTS 582,623 A * 5/1897 Dolley ..... B67C 3/06 141/54
4,137,930 A 2/1979 Scholle
4,493,348 A * 1/1985 Lemmons ..... A61J 7/0053 215/11.1
6,131,767 A * 10/2000 Savage ..... B67D 3/043 222/153.07
6,168,037 B1 * 1/2001 Grimard ..... A61J 1/2096 215/310

(Continued)

FOREIGN PATENT DOCUMENTS

DE 102014116151 B3 1/2016
FR 2742207 A1 6/1997
GB 2442228 A 4/2008

*Primary Examiner* — Timothy P. Kelly
(74) *Attorney, Agent, or Firm* — GableGotwals

(57) ABSTRACT

The method includes providing a fluid-dispensing container having at least a first chamber for containing a fluid to be dispensed therefrom and a valve or tap assembly for dispensing the fluid from the first chamber. The valve or tap assembly having an outlet for dispensing fluid and closure means for the outlet. Steps are provided for a fluid refilling apparatus to engage the valve or tap assembly, moving the closure means of the valve or tap assembly from a closed condition to an open condition, injecting or pumping fluid from the refilling apparatus through the outlet of the valve or tap assembly and into the first chamber, and removing the refilling apparatus from the valve or tap assembly and moving the closure means from the open condition to the closed condition.

9 Claims, 3 Drawing Sheets

(56) References Cited

U.S. PATENT DOCUMENTS

Figure 1A:
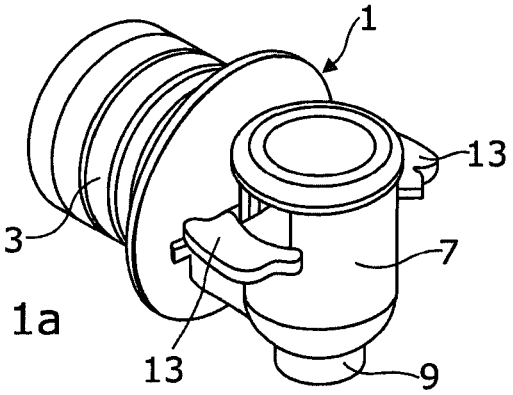
Figure 1B:
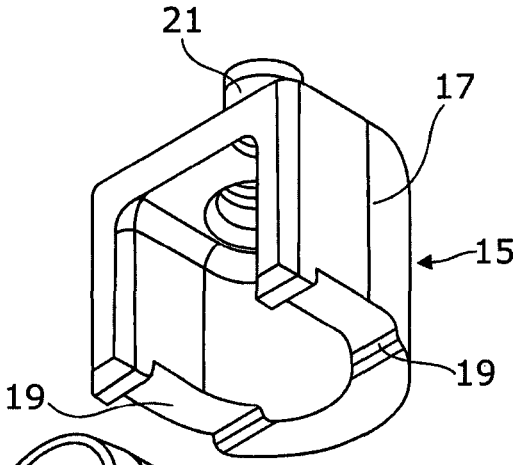
Figure 1B:
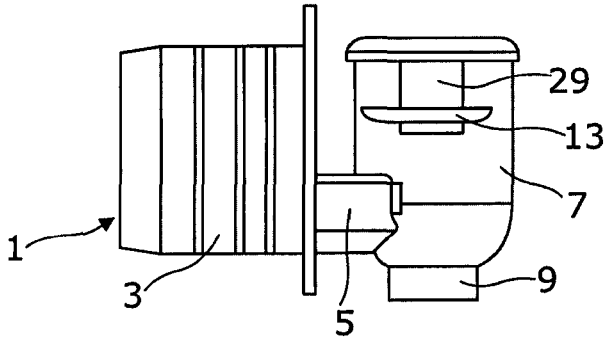

| | | | | |
|---|---|---|---|---|
| 6,925,780 | B1 * | 8/2005 | Anderson | B65B 55/022 53/275 |
| 9,878,098 | B1 * | 1/2018 | Opland | A61M 5/1782 |
| 10,913,582 | B2 * | 2/2021 | Sterling | B65D 25/2894 |
| 2004/0225258 | A1 * | 11/2004 | Balestracci | A61M 5/3134 604/111 |
| 2005/0178462 | A1 * | 8/2005 | Py | B65B 3/003 141/2 |
| 2005/0199313 | A1 * | 9/2005 | Edwards | B65D 41/3409 141/114 |
| 2014/0053950 | A1 * | 2/2014 | Vandersteen | G07F 9/002 222/2 |
| 2014/0246455 | A1 | 9/2014 | Murray | |
| 2015/0344288 | A1 * | 12/2015 | Ortega Collado | F16K 35/10 222/153.14 |
| 2016/0152458 | A1 * | 6/2016 | Clüsserath | B67C 3/10 53/510 |

* cited by examiner

METHOD AND APPARATUS FOR REFILLING A CONTAINER

CROSS-REFERENCE TO RELATED APPLICATIONS

This United States application is the National Phase of PCT Application No. PCT/GB2019/052576 filed 13 Sep. 2019, which claims priority to British Patent Application No. 1814977.3 filed 14 Sep. 2018, each of which is incorporated herein by reference.

The invention to which this application relates is an apparatus and method for refilling a container for subsequent use. In particular, the present invention relates to the refilling of pouches, bags and the like, used to dispense fluid.

Plastic packaging is provided in a multitude of forms, which are used to contain various non consumable substances such janitorial and automotive cleaning substances, body wash and oils, to engineering lubricants, glass, ceramic and PVC cleaning substances. Much emphasis has been placed on recycling such containers once they have been used. However, the amount which is actually recycled is still relatively low. As such, environmental problems arising from discarded plastics, in particular single use plastics are becoming an increasing concern in today's World. Plastic containers used to dispense fluids are a particular issue. Not only are they discarded as soon as they have been emptied, but some designs of these containers are such that they are formed at least partly from a material which is not suitable for recycling, and so the container is discard to general waste. Even those containers which are fully recyclable, a large amount is not actually recycled when finished with.

Containers in the form of bags or pouches which store a fluid therein, for example, boxes of wine wherein the wine is contained within a sealed pouch that is dispensed through a tap, movable between open and closed positions, affixed to the pouch are designed to be single use and discarded once emptied. Such containers are provided to dispense fluid through a user-actuated tap which is connected to the pouch/bag. The taps cannot be removed once they have been fitted and so filling the bag in the original way through the opening provided in the pouch for the tap is no longer possible. The tap includes a main bore which connects into a mating plastic collar connected to the material of the pouch/bag and thus the fluid contents stored therein, and an outlet having a closure mechanism movable between open and closed positions. A user simply moves the tap to an open position to dispense the fluid, moving it back to the closed position when sufficient fluid has been dispensed, a process which is repeated until the bag/pouch is emptied. Rather than rely on a user to recycle the emptied pouch, what is not encouraged at present is the reuse of such bags/pouches—for example for fluids in the form of non-consumable substances which may be refilled into the same container in which they were stored, which can be subsequently reused. Examples may include washing up liquid, fabric conditioner, oils, glass cleaners and the like.

It is therefore an aim of the present invention to provide a method of refilling a container for subsequent use.

It is a further aim of the present invention to provide an apparatus for refilling a container for subsequent use.

According to a first aspect of the invention there is provided a method for refilling a container, said method including:

providing a fluid-dispensing container having at least a first chamber for containing a fluid to be dispensed therefrom, and a valve or tap assembly for dispensing said fluid from the first chamber, said valve or tap assembly having an outlet for dispensing fluid and closure means for said outlet;

providing a fluid refilling apparatus to engage the valve or tap assembly;

moving the closure means of the valve or tap assembly from a closed condition to an open condition;

injecting or pumping fluid from the refilling apparatus through the outlet of the valve or tap assembly and into the first chamber; and removing the refilling apparatus from the valve or tap assembly and moving the closure means from the open condition to the closed condition.

Preferably, said container is a bag or pouch or the like for containing a fluid. Typically, said container is formed at least partially from a plastics material.

In one embodiment, said fluid may be injected and/or pumped from the refilling apparatus through the outlet of the valve or tap assembly and into the first chamber to a predetermined volume. In another embodiment, said fluid may be injected and/or pumped to a range of predetermined volumes which can be selected by a user.

In one embodiment, prior to the injection or pumping of fluid into the at least first chamber, suction means are applied to the outlet of the valve or tap assembly. Typically, said suction means are applied so as to remove residual air remaining in at least the first chamber of the container.

Typically, said refilling apparatus includes an engaging portion which engages said closure means of the valve or tap assembly, moving it from the closed condition to the open condition.

In one embodiment, said closure means is biased to the closed condition, and said engaging portion of the refilling apparatus urges the closure means to the open condition. Typically, said refilling apparatus includes a nozzle member from which fluid is injected and/or pumped into the valve or tap assembly, and which mates with the outlet of the valve or tap assembly simultaneously as the engaging portion engages the closure means.

Typically, as the container is removed from the refilling apparatus, the closure means moves back from the open condition to the closed condition.

Preferably, when engaged with the refilling apparatus, the valve or tap assembly and, thus, the container, are held in an inverted position. This therefore increases the ease by which fluid can enter the container—under gravity—and also prevents fluid leaking back out of the container as the closure means moves from the open condition back to the closed condition.

In one embodiment, the closure means is manually movable between open and closed conditions. Typically, once the refilling apparatus is engaged with the valve or tap assembly, the closure means is manually moved from the closed condition to the open condition, and subsequently fluid is injected and/or pumped therethrough. Further typically, once the container has been refilled with fluid to a selected and/or predetermined amount, the closure means is manually moved from the open condition to the closed condition, and the container subsequently removed from the refilling apparatus.

In one embodiment, after refilling the container with fluid, a security/tamper evident cap/clip/seal/tab is located on the valve or tap assembly. Typically, said security/tamper evident cap or clip is arranged to cover the outlet of the valve or tap assembly and simultaneously prevent movement of the closure means from the closed condition to the open condition.

In one embodiment, said refilling apparatus is provided to refill containers having a valve or tap assembly of the type sold under the registered Trade Marks Liqui-Sure®, Vitop Original® or similar on/off mechanical valve or tap closure.

In one embodiment, indication means may be provided on said container to identify the fluid/product provided therein. Typically, said indication means may be provided in the form of a machine-readable code, such as a barcode, matrix barcode, QR Code® or the like.

Typically, said container and the valve or tap assembly are recyclable and may be disposed for recycling after one or more uses, or if either or both parts become damaged.

In another aspect of the present invention, there is provided an apparatus for refilling a container, said apparatus including:

- an engaging portion arranged to engage a valve or tap assembly of the container, in use;
- a nozzle member arranged to mate with an outlet of a valve or tap assembly of the container, in use;
- fluid supply means arranged to inject and/or pump fluid through said nozzle member and said valve or tap assembly, into the container, in use.

Preferably, said container is a bag or pouch or the like for containing a fluid. Typically, said container is formed at least partially from a plastics material.

In one embodiment, at least part of said engaging portion is arranged to engage a closure means of the valve or tap assembly, in use. Typically, said engaging portion is arranged to move the closure means from a closed condition to an open condition, in use.

In one embodiment, the engaging portion and the nozzle member are arranged such that they simultaneously engage and mate with the closure means and outlet of the valve or tap assembly, respectively, in use.

In one embodiment, said nozzle member includes sealing means, arranged to create a substantially fluid tight seal with said outlet, in use. Typically, said sealing means are provided in the form of an O-ring member. Further typically, said sealing means are formed from a rubber, plastics or silicone material.

In one embodiment, said apparatus may include suction means therewith. Typically, said suction means are provided so as to remove residual air remaining in at least the first chamber of the container prior to the injection or pumping of fluid, in use.

In one embodiment, said engaging portion includes at least one shoulder member for engagement about the valve or tap assembly and with said closure means, in use. Typically, said engagement portion includes two shoulder members for engagement with closure means, in use. Further typically, said shoulder members are arranged to engage closure means of the valve or tap assembly either side of main body portion thereof, in use, and said nozzle member is located intermediate said should members.

In one embodiment, a security/tamper evident cap/clip/seal/tab may be located on the valve or tap assembly. Typically, said security/tamper evident cap or clip is arranged to cover the outlet of the valve or tap assembly and simultaneously prevent movement of the closure means from the closed condition to the open condition.

In one embodiment, said refilling apparatus is provided to refill containers having a valve or tap assembly of the type sold under the registered Trademark Liqui-Sure®, Vitop Original® or similar on/off mechanical valve or tap closure.

Typically, said container provided for refilling and the valve or tap assembly are recyclable and may be disposed for recycling after one or more uses, or if either or both parts become damaged.

Figure 2A:
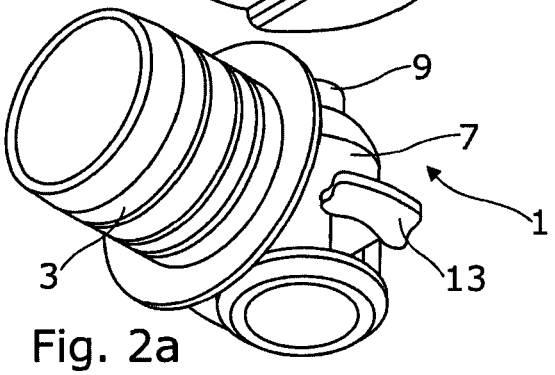
Figure 1C:
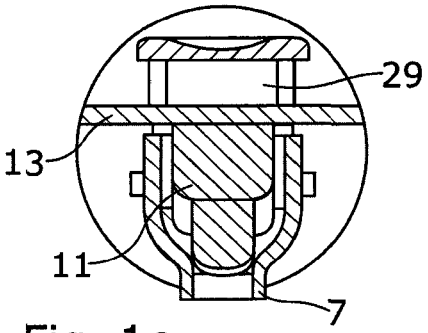
Figure 1D:
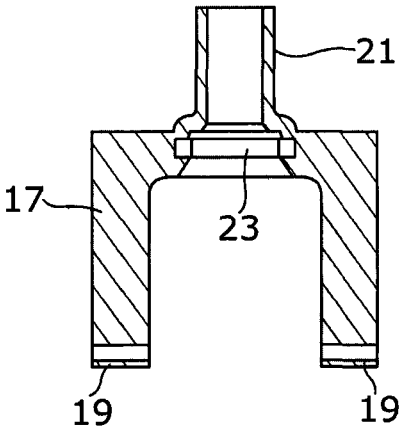
Figure 1D:
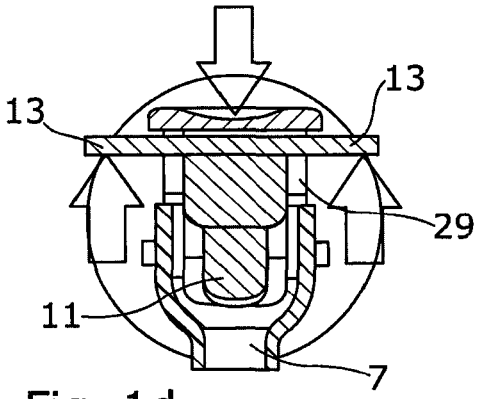
Figure 2B:
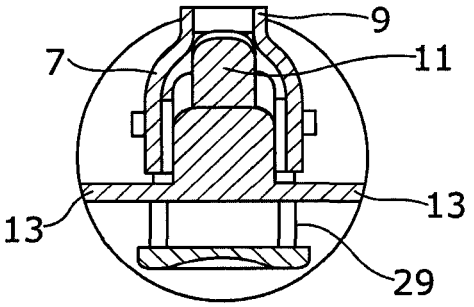
Figure 5A:
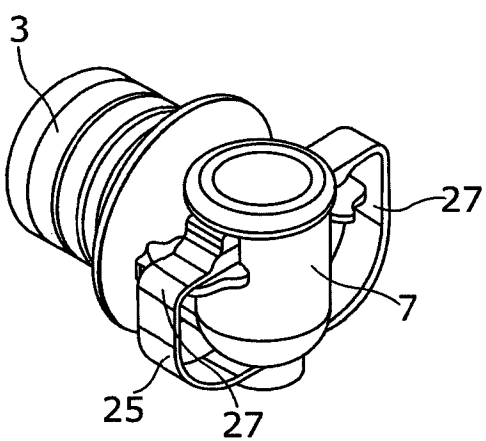
Figure 5B:
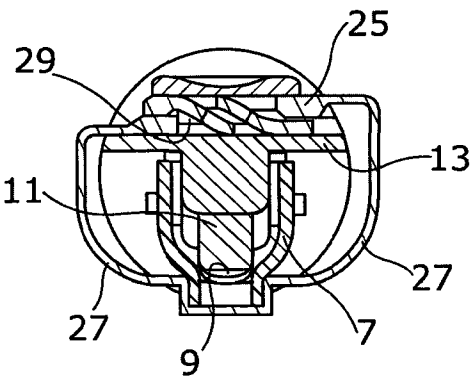
Figure 4A:
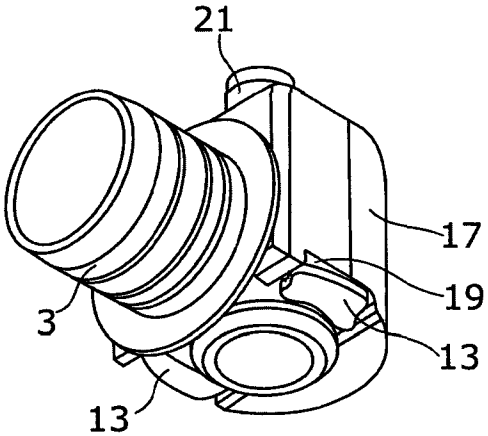
Figure 4B:
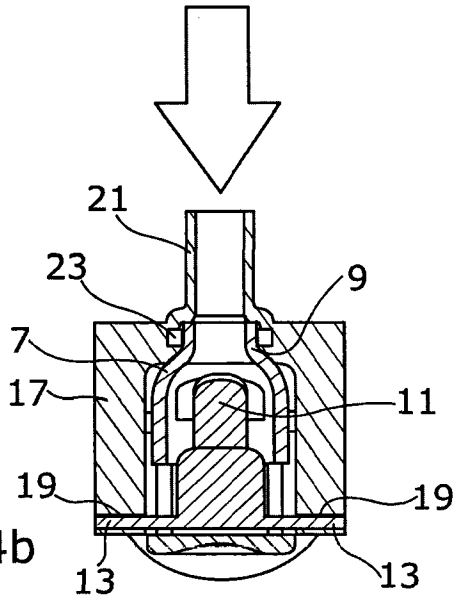
Figure 3A:
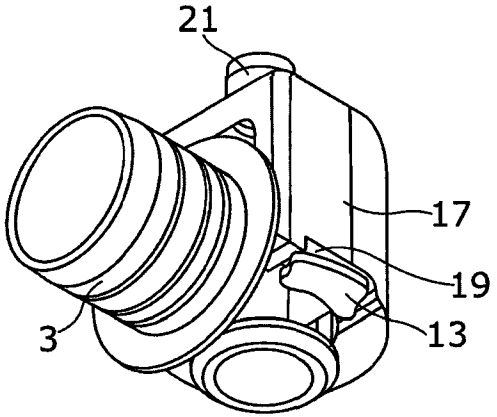
Figure 3B:
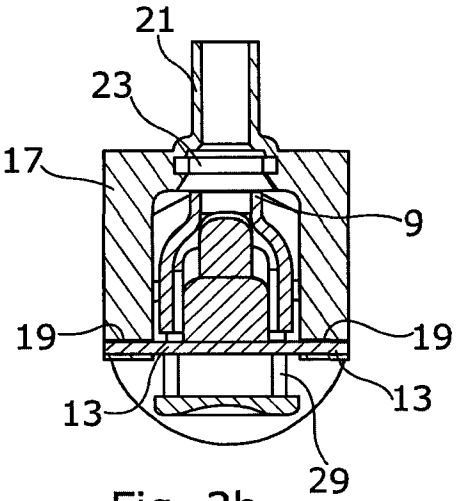
Figure 6A:
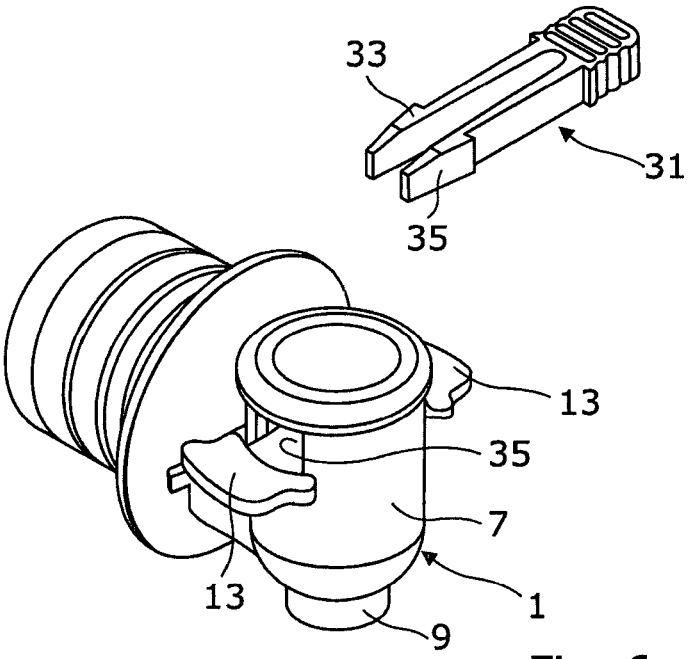
Figure 6B:
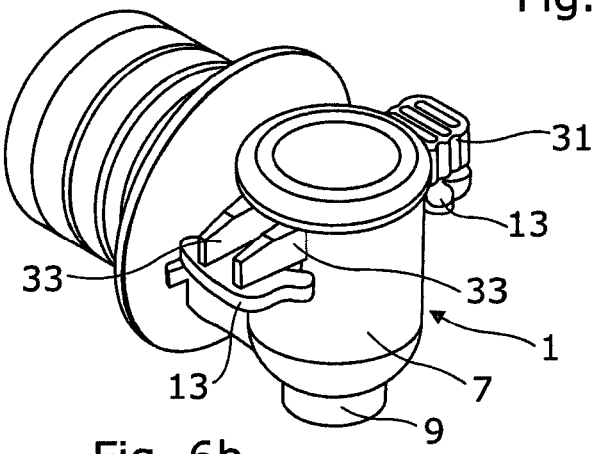
Figure 6C:
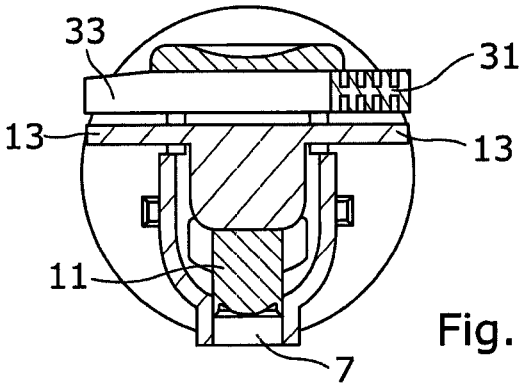

Embodiments of the present invention will now be described with reference to the accompanying figures, wherein:

FIGS. 1*a-d* illustrate views of a valve or tap assembly for a container;

FIGS. 2*a-b* illustrate perspective and cross-sectional views of a valve or tap assembly prior to engagement with an apparatus for refilling a container, in accordance with an embodiment of the present invention;

FIGS. 3*a-b* illustrate perspective and cross-sectional views of an apparatus engaged with a valve or tap assembly of a container, in a closed condition, in accordance with an embodiment of the present invention;

FIGS. 4*a-b* illustrate perspective and cross-sectional views of an apparatus engaged with a valve or tap assembly of a container, in an open condition, in accordance with an embodiment of the present invention;

FIGS. 5*a-b* illustrate perspective and cross-sectional views of a valve or tap assembly with a security/tamper evident cap affixed thereto, in accordance with an embodiment of the present invention; and FIGS. 6*a-c* illustrate perspective and cross-sectional views of a valve or tap assembly with a security/tamper evident clip affixed thereto, in accordance with another embodiment of the present invention.

Referring now to FIGS. 1*a-d*, there is illustrated a valve or tap assembly 1 used to dispense fluid from a container (not shown). The assembly 1 attaches to the container via main bore 3. Fluid flows from the container, which is generally provided in the form of a bag or pouch formed at least partially from a plastics material, through the bore 3, a feeder channel 5 and ultimately to the dispensing portion 7. The dispensing portion 7 includes an outlet 9 and closure means in the form of a valve 11. In a preferred embodiment, the valve 11 is biased to a closed condition, preventing any fluid from being dispensed through the outlet 9. The valve 11 includes one or more tabs or flaps 13 extending outwardly from the dispensing portion 7 of the assembly 1, which are movable in a linear direction against the biasing force of the valve 11 to move it from a closed condition to an open condition, shown in FIG. 1*d*. This subsequently allows fluid to be dispensed from the container. Upon release of the tabs or flaps 13 the valve 11 is biased back to the closed condition. When all the fluid has been dispensed from the container, the container is usually discarded with the waste.

To prevent single use of such containers, the present invention provides an apparatus attachment 15 for refilling the containers directly through the valve or tap assembly 1 through which the fluid is initially dispensed. FIGS. 2*a-b* show perspective views of an apparatus attachment 15 for location with the assembly 1 described above. The apparatus attachment 15 includes a body 17 shaped to engage with the assembly 1, and has engaging portions 19 thereon which engage directly with the tabs or flaps 13 of the valve 11. The apparatus attachment 15 is shown in an engaged relationship with the assembly 1, once all air has been removed from the container to which the assembly is attached, in a closed condition, in FIGS. 3*a-b*. Ideally, all air is removed from the container as this allows liquid to refill the container uninhibited by residual air trying to vent out. In some embodiments, suction means may be provided to ensure all residual air is removed prior to the filling/re-filling of the container. The suction may be set to a timer and run for a user-selected or predetermined duration of time, or the activation and deactivation of the suction means may be manual, at the discretion of the user. The engaging portions of the apparatus attachment 15, in this case shown as a pair of slots 19 arranged to align with and fit over the tabs or flaps 13, engage with the valve 11 to move it from the closed condition to the open condition. As the apparatus aligns over the assembly 1 and the engaging portions 19 engage with the tabs 13 of the valve 11, a nozzle 21 located in an upper portion of the apparatus attachment 15 simultaneously fits over and mates with the outlet 9 of the assembly 1. The nozzle 21 includes a sealing member in the form of an O-ring 23 formed from a rubber, plastics or silicone material. This creates a fluid-tight seal as the nozzle 21 mates with the outlet 9.

Once the apparatus attachment 15 and assembly 1 are engaged with one another, the refilling apparatus attachment 15 is depressed against the tabs 13 of the valve 11, urging it to the open condition, shown in FIGS. 4*a-b*. The apparatus attachment 15 and nozzle 21 are connected to a supply of fluid to flow therethrough and into the outlet 9 of the assembly 1, thereby refilling the container. As the valve 11 is moved to the open condition by the apparatus attachment 15, flow of fluid is initiated and this is injected or pumped through the nozzle 21 and ultimately into the container filling it. A predetermined amount of fluid can be set for refilling the container and when it is reached, the flow of fluid automatically ceases. In another example, the fluid may be injected and/or pumped to one of a range of predetermined amounts, which may be selected as required by a user and can be dependent on the size of the container being filled/re-filled. The refilling apparatus attachment 15 is then detached from the assembly 1, wherein the valve 11 is instantly biased back to the closed condition, sealing the container, now fully refilled with fluid. In order to improve the ease by which the container is refilled, the assembly 1 affixed to the apparatus attachment 15 in an inverted fashion, and thus as fluid is injected, filling the container, it may simply flow under gravity through the nozzle 21, outlet 9, feeder channel 5 and bore 3 into the container. This also ensures, upon release of the assembly 1 from the apparatus attachment 15, that fluid does not inadvertently leak back out prior to full closure of the valve 11.

The flow of fluid being pumped/injected into the container may be mechanically controlled, or the flow may be set to a timer. Types of pumps which may be suitable include but are not limited to gear, rotary or volumetric pumps. The filling process may be manual or automatic. That is to say, as the assembly 1 and apparatus attachment 15 are engaged with one another, a user may activate the fill cycle and pumping/injection of fluid to fill the container or, in some examples, this fill cycle may be set to begin automatically as the assembly and apparatus attachment 15 are engaged. Typically, the refilling method is to be carried out by trained personnel as opposed to the end customer and is designed to work only when the specifically designed valve 1 engages the apparatus attachment 15.

In other embodiments of the present invention the refilling apparatus attachment 15 may be adapted to be used with a valve or tap assembly having closure means which are manually movable between closed and open conditions, for example, a rotatable tap mechanism (not shown). In such examples, the refilling apparatus attachment 15 engages with the assembly 1, and a user subsequently manually moves the valve from the closed condition to the open condition. Alternatively, a semi-automatic valve opening mechanism may be provided with the apparatus attachment 15 to engage the rotatable tap mechanism and move it between the closed and open conditions, as required. The fluid is then permitted to flow through the nozzle 21 filling the container and, if selected, to a predetermined and/or user-selected level. The user then moves the valve back to the closed position and the container may subsequently be released from the refilling apparatus attachment 15 (or alternatively the semi-automatic valve opening mechanism, described above, may be used).

Once the assembly 1 and container have been removed from the refilling apparatus attachment 15, the valve 11 and outlet 9 may be sealed in the closed condition via the provision of a security/tamper evident cap 25, as shown in FIGS. 5*a-b*. The cap 25 is provided to block any access to the outlet 9 of the assembly 1 and prevent movement of the tab or flaps 13 of the valve 11 by providing arm members 27 which extend around the neck 29 of the assembly 1, blocking linear movement of the tabs or flaps 13. In another embodiment of the invention, as shown in FIGS. 6*a-c*, a security/tamper evident clip 31 may be provided to perform the same function as the cap 25. In this example, the clip 31 includes a pair of extending arms 33 which may be inserted through a gap 35 provided in the valve or tap assembly 1, resting on the tabs or flaps 13 and blocking linear movement thereof. Once the container has been refilled and secured with the tamper evident cap 25, it may be provided with indication means used to identify exactly what the contents of the container are, batch number, expiration date if applicable, and further relevant information. This may be provided in a machine readable form, such as a barcode, matrix barcode or QR Code® or the like.

The invention claimed is:

1. A method for refilling a container, said method including:

providing a fluid-dispensing container having at least a first chamber for containing a fluid to be dispensed therefrom, and a valve assembly or tap assembly for dispensing said fluid from the first chamber, said valve assembly or tap assembly having an outlet for dispensing fluid and a valve for said outlet, said valve being biased to a closed position;

dispensing fluid from said fluid-dispensing container to empty the same;

providing a fluid refilling apparatus to engage the valve assembly or tap assembly;

moving the valve of the valve assembly or tap assembly from a closed condition to an open condition;

injecting or pumping fluid from the refilling apparatus through the outlet of the valve assembly or tap assembly and into the first chamber to refill the same; and removing the refilling apparatus from the valve assembly or tap assembly such that the valve is instantly biased from the open condition to the closed condition, sealing the refilled container;

after refilling the container with fluid, locating an anti-tamper clip on the valve assembly or tap assembly, the anti-tamper clip having a pair of depressible arms which extends into a gap in a neck of the valve assembly or tap assembly, physically blocking linear movement of one or more tabs or flaps of the valve.

2. A method according to claim 1, wherein said fluid is injected and/or pumped from the refilling apparatus through the outlet of the valve assembly or tap assembly and into the first chamber to a predetermined volume.

3. A method according to claim 1, wherein said fluid is injected and/or pumped from the refilling apparatus through the outlet of the valve assembly or tap assembly and into the first chamber to a range of predetermined volumes selected by a user.

4. A method according to claim 1, wherein said refilling apparatus includes an engaging portion which engages said valve of the valve assembly or tap assembly, moving the valve from the closed condition to the open condition.

5. A method according to claim 4, wherein, said valve is biased to the closed condition, and said engaging portion of the refilling apparatus urges the valve to the open condition.

6. A method according to claim 5, wherein said refilling apparatus includes a nozzle member from which fluid is injected and/or pumped into the valve assembly or tap assembly, and which mates with the outlet of the valve assembly or tap assembly simultaneously as the engaging portion engages the valve.

7. A method according to claim 1, wherein as the container is removed from the refilling apparatus, the valve moves back from the open condition to the closed condition.

8. A method according to claim 1 wherein when engaged with the refilling apparatus, the valve assembly or tap assembly and, thus, the container, are held in an inverted position.

9. A method according to claim 1, wherein said anti-tamper clip is arranged to cover the outlet of the valve assembly or tap assembly and simultaneously prevent movement of the valve from the closed condition to the open condition.

* * * * *